US005275145A

United States Patent [19]

Tuckey

[11] Patent Number: 5,275,145

[45] Date of Patent: Jan. 4, 1994

[54] VAPOR RECOVERY SYSTEM FOR MOTOR VEHICLES

[75] Inventor: Charles H. Tuckey, Cass City, Mich.

[73] Assignee: Walbro Corporation, Cass City, Mich.

[21] Appl. No.: 986,374

[22] Filed: Dec. 7, 1992

[51] Int. Cl.[5] ..... F02M 37/04

[52] U.S. Cl. ..... 123/521; 123/516; 123/525; 123/456

[58] Field of Search ..... 123/518, 519, 520, 521, 123/516, 525, 1 A, 456

[56] References Cited

U.S. PATENT DOCUMENTS

| | | | |
|---|---|---|---|
| 3,957,025 | 5/1976 | Heath | 123/518 |
| 4,059,081 | 11/1977 | Kayanuma | 123/520 |
| 4,070,828 | 1/1978 | Barres | 123/521 |
| 4,499,885 | 2/1985 | Weissenbach | 123/525 |
| 4,617,904 | 10/1986 | Pagdin | 123/525 |
| 4,760,832 | 8/1988 | Smith | 123/525 |
| 4,829,968 | 5/1989 | Onufer | 123/520 |
| 4,876,993 | 10/1989 | Slattery | 123/516 |
| 4,982,715 | 1/1991 | Foster | 123/518 |
| 5,080,078 | 1/1992 | Hamburg | 123/521 |

FOREIGN PATENT DOCUMENTS

| | | | |
|---|---|---|---|
| 2547065 | 9/1977 | Fed. Rep. of Germany | 123/516 |
| 0128438 | 8/1983 | Japan | 123/520 |

*Primary Examiner*—Carl S. Miller

*Attorney, Agent, or Firm*—Barnes, Kisselle, Raisch, Choate, Whittemore & Hulbert

[57] ABSTRACT

A system for automotive vehicles carrying a fuel tank for volatile fuels which is directed to avoiding the escape to atmosphere of fuel vapors which rise from the liquid fuel. The system includes a collector dome on the fuel tank and a storage canister for vapors. A vapor pump is provided for reducing the stored vapor to liquid before directing it from a high pressure tank into the fuel supply leading to the engine of the vehicles. The vapor pump is powered by an electrical source or, alternatively, by the vehicle engine. A pressure responsive switch controls the initiation of the vapor pump action. A standard fuel pump in the fuel tank delivers liquid fuel to the fuel injection system of the engine.

8 Claims, 2 Drawing Sheets

VAPOR RECOVERY SYSTEM FOR MOTOR VEHICLES

FIELD OF THE INVENTION

In a vehicle fuel system, the recovery of vapors from volatile fuels and return to fuel supply.

BACKGROUND AND FEATURES OF THE INVENTION

As long as motor vehicles have been using volatile fuels in tanks carried on the vehicle, there has been a problem with fuel vapors. Gas caps had to have a vent hole in the early days especially when gravity feed of the fuel was used. Later as fuel pumps were used vapor was still a problem since in hot weather or bumper-to-bumper progress, overheating of the gasoline lines would cause vapor lock resulting in an interruption of fuel supply. With the advent of fuel injection, the problem has been alleviated but in hot climates or under certain conditions of ambient temperatures vapor has continued to be a problem. Fuel pumps have been designed with vapor ports to remove vapor in the liquid fuel outlets.

In geographic areas where temperatures reach 90° F. or 120° F. or more, a vehicle standing in the sun will cause vaporization in the top of fuel tanks and also in the fuel lines. Another aspect lies in the environmental problems which require that there be as little as possible of vapor escaping from fuel systems or fuel tanks in normal operation.

Accordingly, the present invention is directed to an automotive vehicle system in which recovery of vapor is accomplished, and, the liquid fuel resulting from the compression of the vapor, is fed back into the fuel line leading to the fuel injection system of the engine.

An object of the invention will also be to provide pressure responsive switches to maintain the functioning of the system, and vapor retaining canisters to collect vapor from a fuel tank and return it to the fuel system in the form of liquid fuel. Another object is the utilization of an engine off-drive for a vapor pump which can be clutch controlled by a pressure responsive switch.

Other objects and features of the invention will be apparent in the following description and claims in which details of the invention are set forth to enable those skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

BRIEF DESCRIPTION OF THE INVENTION

A system for automotive vehicles carrying a fuel tank for volatile fuels which is directed to avoiding the escape to atmosphere of fuel vapors which rises from the liquid fuel. The system includes a collector dome on the fuel tank and a storage canister for vapors. A vapor pump is provided for reducing the stored vapor to liquid before directing it from a high pressure tank into the fuel supply leading to the engine of the vehicles. The vapor pump is powered by an electrical source or, alternatively, by the vehicle engine. A pressure responsive switch controls the initiation of the vapor pump action. A standard fuel pump in the fuel tank delivers liquid fuel to the fuel injection system of the engine.

DETAILED DESCRIPTION OF THE INVENTION AND THE MANNER AND PROCESS OF USING IT

Figure 2:
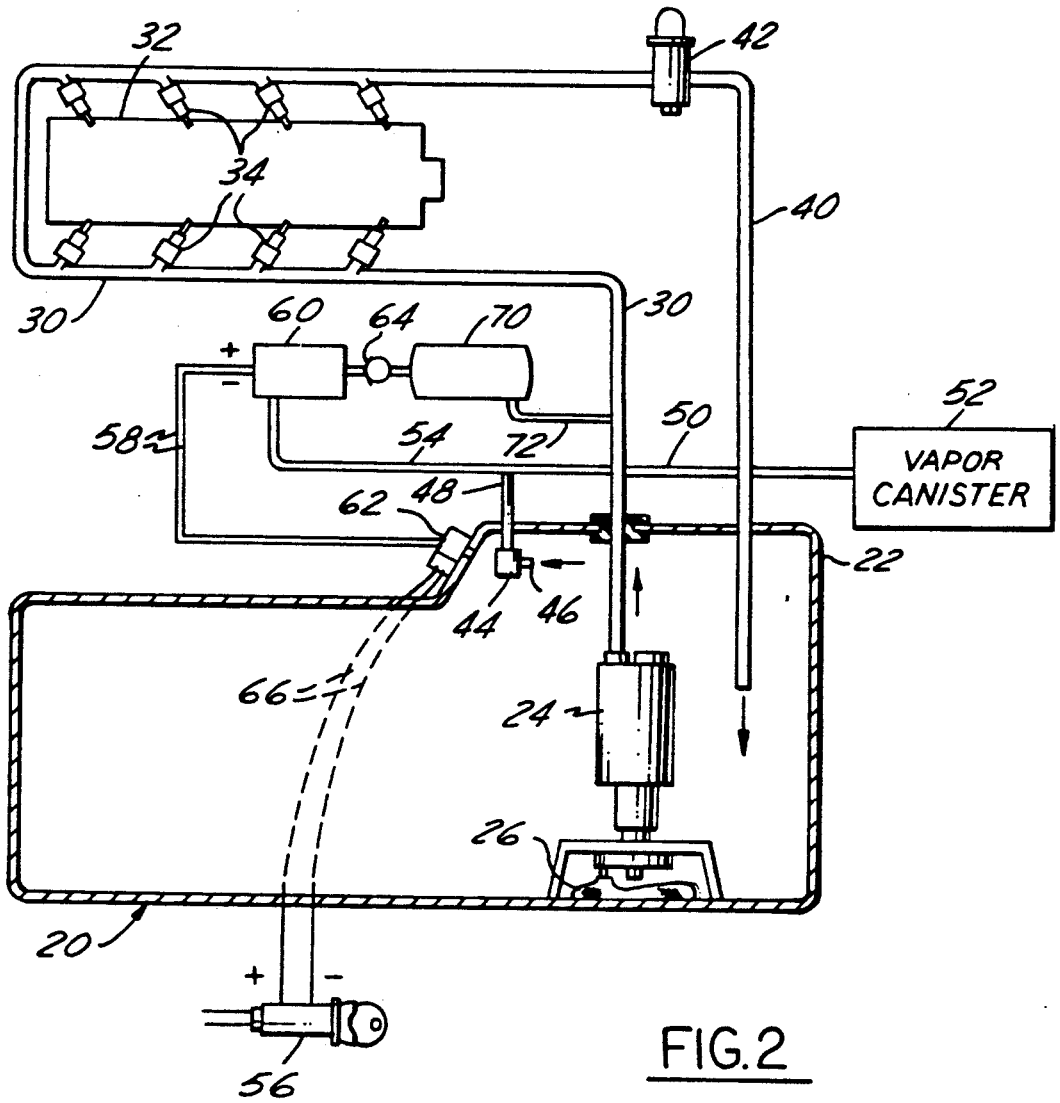
FIG. 2, a diagrammatic view of a vapor replacement system with an electrically driven vapor compression pump.

With reference to the drawings, in diagrammatic FIG. 2, a fuel tank 20 has a raised portion 22 in the form of a dome into which vapor from the stored liquid fuel will rise and collect. A fuel pump 24, electrically powered, is located in the fuel tank in a conventional way with an inlet pick-up filter 26 lying on the bottom of the tank. A pump outlet line 30 leads to the fuel injection system of an engine 32 with fuel injectors 34. The fuel line 30 continues past the fuel injectors in a return line 40 leading back to the tank 20. A pressure regulator 42 is installed in the return line 40.

In the vapor dome 22 is a roll-over valve 44 which has an inlet 46 from dome 22. A roll-over valve shuts off fuel from the tank in case a vehicle is overturned. The inlet 46 intended to receive vapor from the dome 22 leads to conduit 48 with a T-connection to line 50 connected to a vapor canister 52 and a line 54 connected to the inlet of a vapor compression pump 60. The vapor canister 52 has a charcoal charge to receive vapor from the fuel tank when the engine is not running. This will occur under conditions when the rising ambient temperature causes the liquid fuel in the fuel tank to vaporize and pass through inlet 46 to lines 48,50 and 54.

The vapor compression pump 60, when electrically operated, pulls vapor from the fuel tank dome 22 through lines 46,48 and 54 and also from the canister 52 through line 50. The actuation of the vapor pump 60 is controlled by a pressure switch 62 which is responsive to tank vapor pressure in the dome 22. This switch can be energized through an ignition switch 56 but also may be independent of the ignition switch and responsive only to tank pressure acting on the pressure switch 62. Lines 58 connect the pressure switch 62 to the pump 60. Lines 66 connect ignition switch 56 to the pump 60 through switch 62.

A check valve 64 between the vapor pump 60 and a high pressure tank 70 prevents backflow from the tank 70. A conduit 72 connects the bottom of the high pressure tank 70 to the fuel supply line 30 leading to the engine. Thus, the compressed fuel vapor in the form of liquid is fed from tank 70 to the line 30 where it mixes with fuel delivered to the fuel rail.

The system illustrated in FIG. 2 is shown with a fuel return line 40 and a pressure regulator 42. Some systems now in use utilize fuel pumps responsive to fuel line pressure and there is no return line needed, and, accordingly, no pressure regulator is needed. An example of a "no-return" line system is found in U.S. Pat. No. 5,044,344, issued Sep. 3, 1991.

With reference to FIG. 2, the heating of liquid fuel in the tank 20 may occur due to high ambient temperatures in warmer climates and also due to return fuel in return line 40 which may become heated as it passes the engine compartment. This heating will cause a build-up of vapor in the tank dome 22. When this occurs, the pressure switch 62 will be actuated to start the vapor compression pump 60. A pressure rise of 1 pound per square inch might be a possible setting for switch 62.

The pump 60 will draw vapor from the vapor canister 52 through line 50 as well as from the vapor dome 22 through passage 46 to the pressure tank 70. The compressed vapor will be liquified and directed through passage 72 to the main fuel line 30. When pressure is reduced in the canister 52 and the dome 22, below the threshold setting of the pressure responsive valve 62, the pump 60 will cease to operate.

This system has the advantage of conserving fuel as well as avoiding the escape of fuel vapors into the atmosphere.

Figure 1:
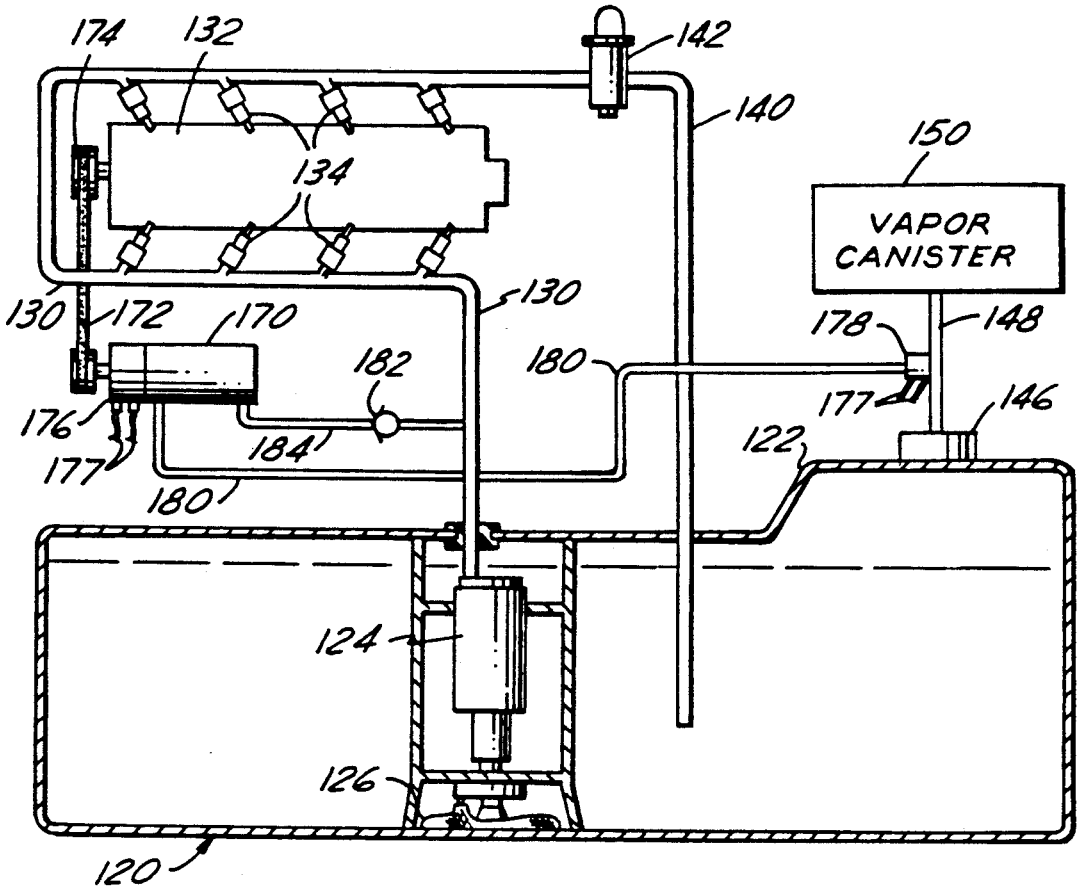
FIG. 1, a diagrammatic view of a vapor replacement system in which a vapor pump is driven by a vehicle engine.

In FIG. 1, a modified system is illustrated in which the vapor compression pump is driven by the engine of the system rather than by an electric supply.

A main fuel tank 120 has a dome section 122, and a fuel pump 124 with a pick-up 126 is mounted in the tank. A fuel supply line 130 leads to the fuel rail of an engine 132 and the fuel injectors 134. A fuel return line 140 going to the tank has a pressure regulator 142 mounted therein. A connection 146 at the top of the dome 122 opens to a line 148 leading to a vapor storage container 150 containing a charcoal charge where vapor collects when fuel in the main tank is heated.

A vapor compression pump 170 is provided, driven by a belt 172, on a pulley 174 associated with the engine 132. A clutch 176 is provided to engage the pump in response to pressure in the vapor canister as reflected on a pressure switch 178 which is electrically connected to the clutch 176 by lines 177. The inlet of the pump 170 is connected to the vapor canister by a conduit 180. Thus, in response to a predetermined pressure in the vapor canister, the clutch 176 will engage to drive pump 170 and draw vapor from the canister to compress it to liquid. The pump outlet is connected through a one-way valve 182 in line 184 to fuel line 130 leading to the fuel rail of the engine. The operation is essentially the same as described in connection with FIG. 2.

Figure 3:
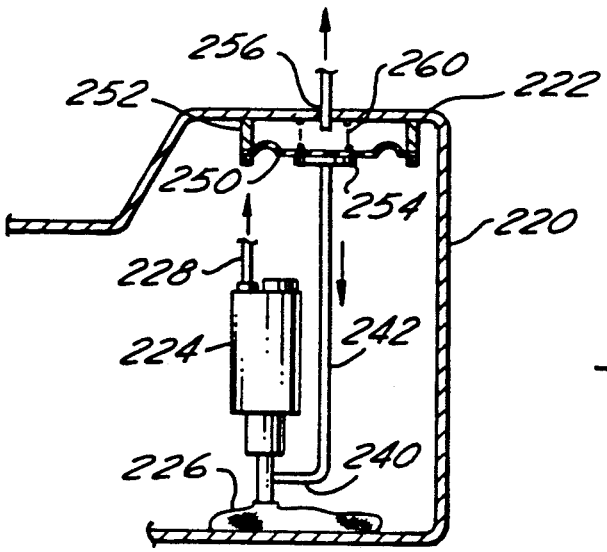
FIG. 3, a fragmented view of an in-tank valve to respond to vapor pressure for pump inlet collection.

In FIG. 3, a fuel tank 220 has a vapor dome 222 with a fuel pump 224 mounted in the tank having a bottom inlet 226 and a pump fuel outlet 228. A second pump inlet conduit 240 opens to the base of the pump and connects to an upright conduit 242 on the open top of which rests the center of a diaphragm 250, the periphery of which is supported in a cage 252. The top of the conduit 242 serves as a valve seat for the diaphragm center 254.

The chamber above the diaphragm is open to atmosphere at 256. A spring 260 with a predetermined rating bears against the diaphragm 250 to seal the top of the conduit 242. When vapor pressure develops in the tank dome 222 to bear on the diaphragm 250 and overcome spring 260, the diaphragm will lift and allow vapor to pass into conduit 242 and into fuel pump 224. The pump will have sufficient capacity to compress the vapor into liquid and pass it as liquid into the pump outlet 228.

What is claimed is:

1. A vapor retrieval system for a volatile fuel supply circuit for an engine with at least one fuel injector which comprises:

(a) a fuel tank having an upper dome portion for collecting fuel vapor from stored volatile liquid fuel, (b) a main fuel pump in said tank having an inlet and an outlet for delivering liquid fuel, (c) a fuel supply conduit for liquid fuel communicating with said outlet of said pump and leading to at least one fuel injector of the engine, (d) passage means connecting said dome with the pump inlet and having a standpipe in said tank open at one end to the pump inlet and open at the other end to the vapor dome, and (e) pressure responsive means responsive to vapor pressure in said dome for connecting said passage means to said pump inlet and having a resiliently biased diaphragm closing said standpipe and responsive to vapor pressure in said tank to open and admit vapor through said standpipe to said pump inlet for said pump to compress the vapor and deliver liquid fuel to the fuel injector of the engine.

2. A vapor retrieval system for a volatile fuel supply circuit for an engine with a fuel injector which comprises:

(a) a fuel tank having an upper dome portion for collecting fuel vapor from stored volatile liquid fuel, (b) a main fuel pump in said tank for delivering liquid fuel to a fuel supply conduit leading to at least one fuel injector of the engine, (c) a vapor storage canister open to said dome portion to receive fuel vapor from said dome portion, (d) a fuel vapor compression pump having an inlet in communication with said canister and an outlet, (e) means connecting said compression pump outlet with said fuel supply conduit downstream of said main fuel pump and upstream of the fuel injector of the engine, whereby vapor accumulated in said dome and said canister can be compressed and delivered as liquid fuel to the fuel injector of the engine.

3. A vapor retrieval system for an engine fuel supply circuit as defined in claim 2 in which means is also provided to connect said inlet of said vapor compression pump to said dome portion as well as to said canister.

4. A vapor retrieval system for an engine fuel supply circuit as defined in claim 2 in which said means connecting said compression pump outlet with said fuel supply conduit includes a high pressure tank connected between said compression pump outlet and said fuel supply conduit.

5. A vapor retrieval system for an engine fuel supply circuit as defined in claim 2 in which a one-way valve is interposed between said vapor compression pump and said fuel supply conduit.

6. A vapor retrieval system for an engine fuel supply circuit as defined in claim 4 in which a one-way valve is interposed between said vapor compression pump and said high pressure tank.

7. A vapor retrieval system for an engine fuel supply circuit as defined in claim 2 in which a rotary drive means connects said engine and said vapor compression pump to be driven when said engine is running, an electrically actuated clutch means between said rotary drive means and said vapor compression pump, and a vapor pressure actuated switch responsive to vapor pressure in said dome connected to said clutch means to cause said compression pump to operate in response to a predetermined pressure in said dome.

8. A vapor retrieval system for an engine fuel supply circuit as defined in claim 2 which also comprises: a vapor pressure actuated switch responsive to vapor pressure in said dome and operably associated with said compression pump to operate said compression pump in response to a predetermined pressure in said dome.

* * * * *